United States Patent [19]

Plunkett, III

[11] Patent Number: 4,733,861

[45] Date of Patent: Mar. 29, 1988

[54] MULTI-USE EXERCISE DEVICE

[76] Inventor: Hugh V. Plunkett, III, 300 Stonebridge Blvd., St. Paul, Minn. 55105

[21] Appl. No.: 803,112

[22] Filed: Nov. 29, 1985

[51] Int. Cl.[4] ..... A63B 21/02

[52] U.S. Cl. ..... 272/137; 272/75

[58] Field of Search ..... 272/93, 125, 135–139, 272/141–143, 74, 75

[56] References Cited

U.S. PATENT DOCUMENTS

| | | | |
|---|---|---|---|
| 85,514 | 1/1869 | Cross . | |
| 1010015 | 11/1911 | Caddy . | |
| 1,698,831 | 1/1929 | Tins | 272/137 |
| 1,817,616 | 8/1931 | Goff . | |
| 2,224,103 | 12/1940 | Nilson | 272/142 X |
| 2,723,121 | 11/1955 | Cartwright et al. . | |
| 4,059,265 | 11/1977 | Wieder et al. | 272/137 |
| 4,090,705 | 5/1978 | Young | 272/75 |
| 4,093,211 | 6/1978 | Hughes et al. | 272/75 X |
| 4,109,906 | 8/1978 | Wilson | 272/75 |
| 4,158,457 | 6/1979 | Hydro | 272/75 |
| 4,201,382 | 5/1980 | Wilson | 272/75 |
| 4,245,840 | 1/1981 | Van Housen | 272/137 |
| 4,361,324 | 11/1982 | Baroi | 272/142 X |
| 4,373,716 | 2/1983 | Pagani | 272/142 X |
| 4,440,391 | 4/1984 | Saenz, Jr. et al. | 272/93 |
| 4,489,934 | 12/1984 | Miller | 272/75 |
| 4,505,474 | 3/1985 | Mattox | 272/75 |

FOREIGN PATENT DOCUMENTS 164848 7/1958 Sweden .

OTHER PUBLICATIONS

Advertisement for "Lifeline Gym", Bicycling, p. 82, Jan. 1985.

*Primary Examiner*—Richard J. Apley
*Assistant Examiner*—Robert W. Bahr
*Attorney, Agent, or Firm*—Merchant, Gould, Smith, Edell, Welter & Schmidt

[57] ABSTRACT

A multi-use exercise device having an elastic, flexible line with a length sufficient for an operator to use the line as a jump rope. A pair of rigid handles are attached to free ends of the lines. The handles are attachable to form a longitudinal composite handle. A pair of rings are carried on free ends of the handle and are sized to be received on the line when the line is folded onto itself with the ring slipped over the fold and retaining the line in the folded position to thereby shorten the length or modify the shape of the line.

9 Claims, 10 Drawing Figures

FIG. 8
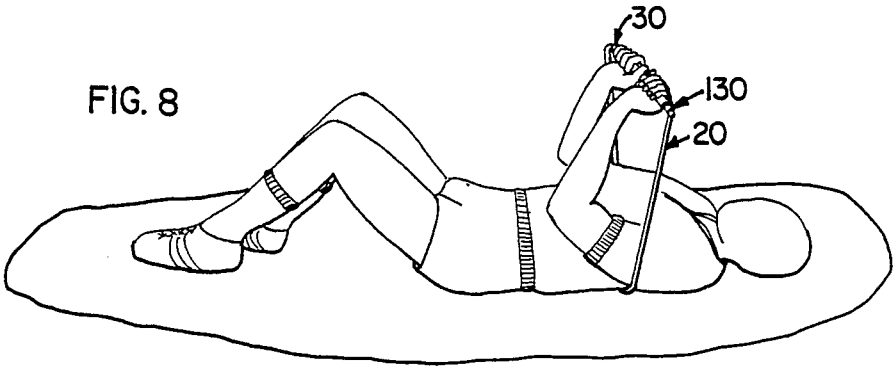
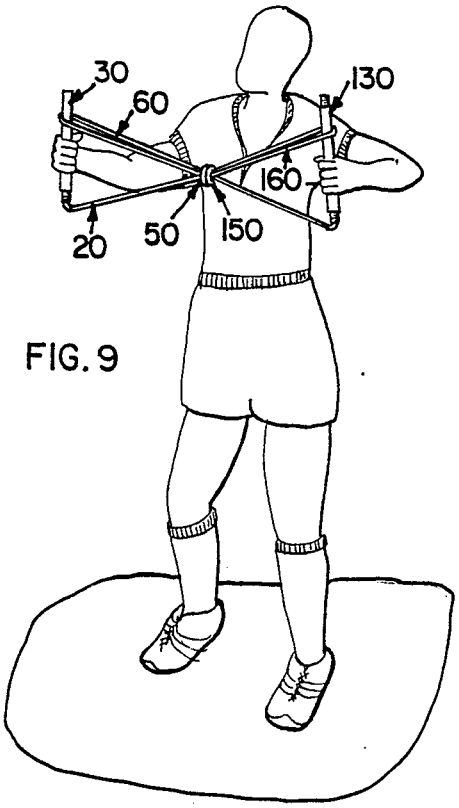
FIG. 9
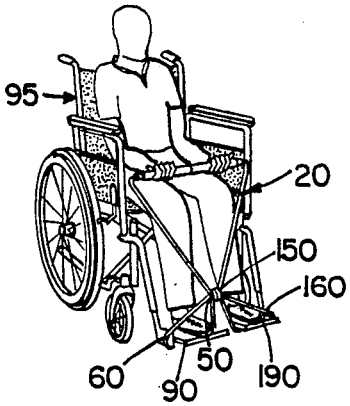
FIG. 10

FIG. 4
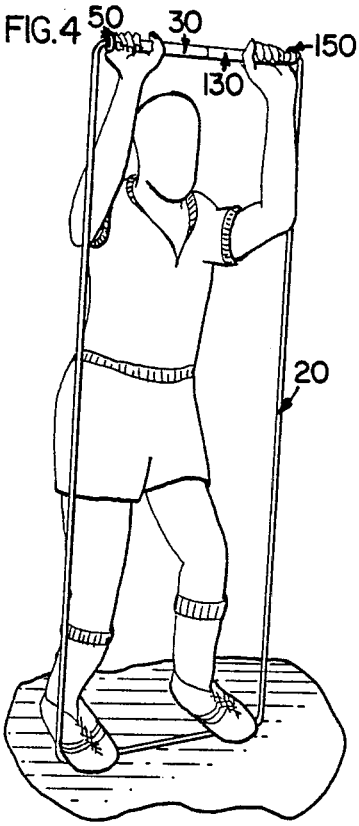
FIG. 5
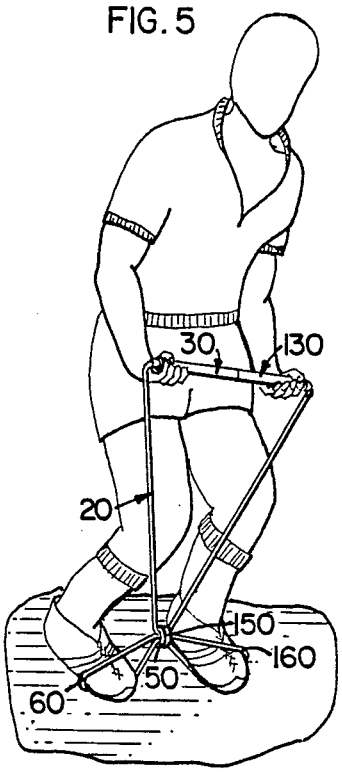
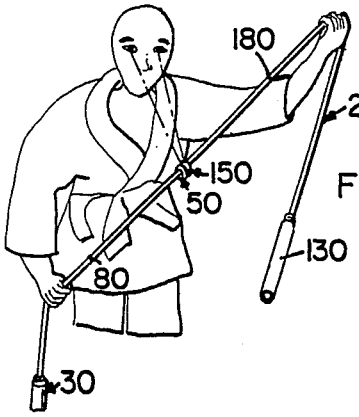
FIG. 7
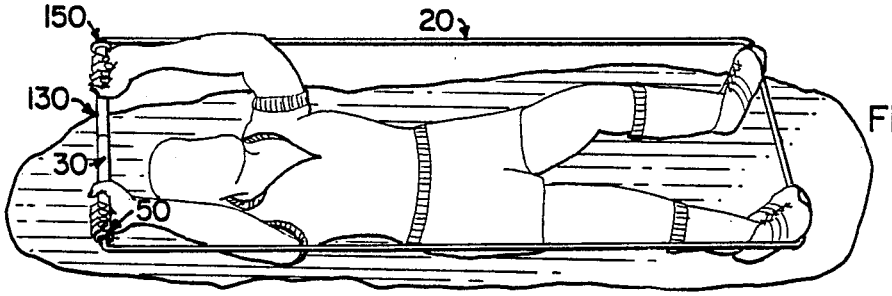
FIG. 6

MULTI-USE EXERCISE DEVICE

BACKGROUND OF THE INVENTION

I. Field of the Invention

This invention pertains to exercise equipment and more particularly, this invention pertains to exercise equipment which serves a variety of useful exercise purposes.

II. Description of the Prior Art

In recent years, increasing attention has been paid by individuals to the need to exercise regularly. Public education concerning health has sparked renewed interest in individual programs of diet and regular exercise. Individuals familiar with exercise programs realize the program must address a number of health needs as efficiently as possible. For example, a proper exercise program will include aerobic exercise (such as jumping rope or jogging), muscle development programs (such as weight lifting or rowing), stretching and conditioning programs. Very specialized exercises have been developed for particular activities. For example, tennis players commonly perform exercises for the muscles controlling eye movement to help improve peripheral vision.

To accommodate the various exercise groups necessary to develop a well-rounded exercise program, the art has been flooded with a variety of exercise equipment. Examples range from jump ropes to elaborate universal machines for weight lifting. In between, the art contains various exercise devices such as stationary bicycles, rowing machines and numerous other equipment.

Notwithstanding the large amount of exercise equipment currently available, there is continuous need for additional exercise equipment to overcome certain problems still present in the art which act as barriers to a large portion of the population being able to develop meaningful and regular exercise programs. First, most of the exercise equipment currently available is directed toward a singular exercise group such as aerobic exercise or muscle development exercise. For example, a jump rope is effective for aerobic exercise but not effective for developing muscle tone. Conversely, weight lifting equipment is excellent for muscular development but has little cardiovascular benefits. Another problem associated with the prior art devices is that the equipment can be extremely expensive. Finally, due to the bulk of much of the equipment and the fact that much of it is dedicated to a particular exercise group, a person attempting to develop a meaningful and regular exercise program must have a variety of exercise devices readily available. In today's society which involves substantial travel and time spent in office, such prior art equipment cannot be relied upon to provide meaningful and regular exercise in all necessary exercise groups in a variety of settings.

It is an object of the present invention to present a multi-use exercise device which is inexpensive to manufacture and which is readily transportable during travel so that a regular program of effective and complete physical fitness can be maintained. It is also an object of the present invention to provide an exercise apparatus which can be used in an exercise program to address a variety of exercise needs such as cardiovascular conditioning, muscle development, stretching and coordination exercises.

SUMMARY OF THE INVENTION

According to a preferred embodiment of the present invention an exercise apparatus is disclosed comprising an elastic flexible line having a length sufficient for an operator to use the line as a jump rope. A pair of rigid handles are attached to free ends of the line. Means are provided for joining the handles into a singular longitudinal handle. Carried on the handle ends are rings sized to be received on the line whereby the line may be folded over onto itself and one or both of the rings slipped over the fold with the rings maintaining the line in the folded position thereby shortening the length of the line or selectively modifying the shape of the line.

BRIEF DESCRIPTION OF THE DRAWINGS

FIGS. 4 through 10 are views showing an operator using an apparatus of the present invention in a variety of different modes to perform different exercises.

DESCRIPTION OF THE PREFERRED EMBODIMENT

Figure 1:
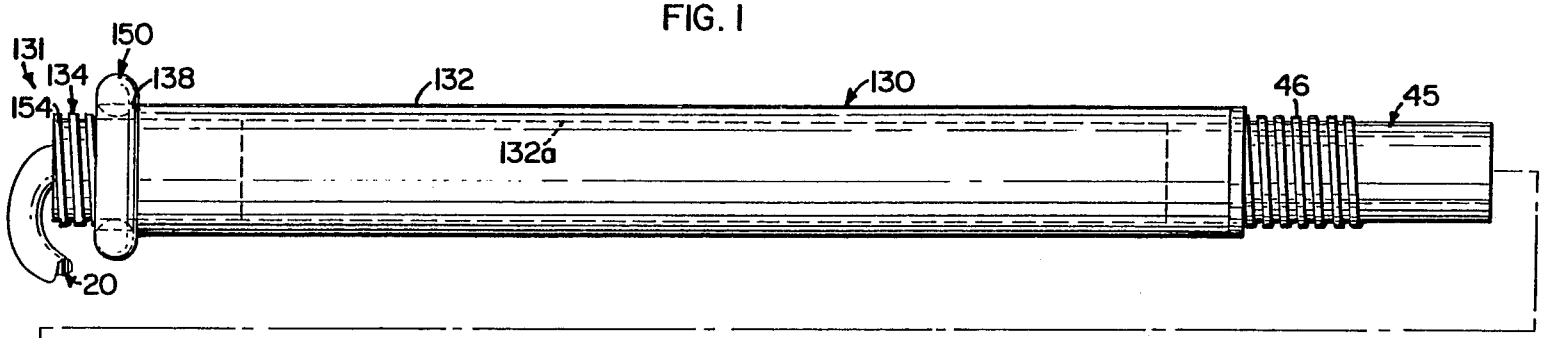
FIG. 1 is a view shown partially in section of exercise apparatus according to the present invention.

With reference to the drawings and most particularly with reference to FIG. 1, an exercise apparatus according to the present invention is shown. The appartus includes a line 20 which is made from any suitable elastic flexible material such as elastic synthetic rubber, elastic nylon cord or other elastic cording. The line 20 is selected to have a length sufficient for an operator to use the line as a jump rope.

A pair of rigid longitudinal handles 30 and 130 are provided. Each of the handles 30 and 130 is provided with a line receiving end 31 and 131, respectively.

As shown, the handles 30 and 130 each comprise an elongated cylindrical body 32 and 132, respectively. At the line receiving ends 31 and 131, the handles 30 and 130 are each provided with a ring retainer in the form of a threaded stud 34 and 134 which is axially aligned with the cylindrical bodies 32 and 132 and are received within bores **32*a* and 132*a* extending through the body portions. The retainers 34 and 134 are identical and each is provided with axially extending bores such as 34*a* extending therethrough. Free ends of the retainers 34 and 134 are provided with inwardly projecting radial flanges such as at 36. The opposing surfaces of the flanges each define reduced diameter portions of bores such as 36*a* of bore 34*a*. As is apparent from the drawings, the retainers 34 and 134 are of a smaller outside diameter than the body portions 32 and 132 resulting in the body portions presenting a radial stop surface 38 and 138 opposing the free ends 31 and 131**.

While the ring retainers have been shown and described as threaded studs, it will be appreciated it is not intended to limit the scope of the invention to this structure. Alternative designs are intended to be included within the scope of this invention and may include other structure for releasably engaging rings 50 and 150 on handles 30 and 130, as will be described. For example, the ends of handle 30 and 130 could be provided grooved, lipped or flanged ends sized to receive rings 50 and 150.

Referring now to handle 30, it can be seen that the end of the body 32 opposite the line receiving end 31 is provided with internal threads 40 disposed within bore 32*a*. Handle 130 on an end of body 132 opposite line receiving end 131 is provided with an axially aligned stud 45 having external threads 46 with the stud 45 sized to be received within bore 32 with threads 46 threadedly engaging internal threads 40 and rigidly securing handle 30 to handle 130 with the two handles threadedly engaged and comprising a composite handle which is an elongated cylinder. Preferably handles 30 and 130 are provided with body portions 32 and 132 of identical diameter and length with the length selected such that that lengths of the composite handle between retainers 34 and 134 is approximately equal to the shoulder span of an adult.

An alternative structure is to provide both of handles 30 and 130 with internal threads such as threads 40. With this structure, an independent stud would be provided having two axially aligned externally threaded studs sized to be received within bores 32*a* and 132*a* and threadedly engage the internal threads of both handles with the handle axially aligned to form a composite handle.

As can be seen from the drawings, the reduced diameter portions of stud bores (best shown with reference to reduced diameter portion 36*a* of bore 34*a* through retainer 34) are sized to freely receive line 20 through the reduced diameter portions. With the line 20 extending through the reduced diameter portions into the stud bores, the ends of the line are knotted (such as at 39) with the knots having a size too large to pass through the reduced diameter portions. Alternatively, the ends of line 20 could be secured to handles 30 and 130 by bearings which rotate about an axis coaxial with the handles to permit free relative rotation of the line ends and the handles.

Figure 2:
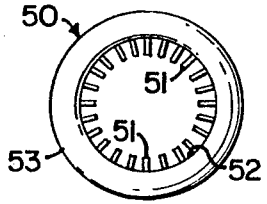
FIG. 2 is a plan view of a ring for an exercise of the present invention.

The apparatus includes a pair of rings 50 and 150. The rings 50 and 150 are identical and a description of ring 50, with reference to FIG. 2, will suffice as a description of ring 150 and similar parts will be numbered similarly. Ring 50 is formed of synthetic material and is flexible. The ring is provided with a toroidal body 53 having a cylindrical inner surface 52. A plurality of flexible ribs 51 are disposed on inner surface 52 of ring 50 and project radially inwardly with the ribs 51 being aligned with the axis of ring 50. The ring 50 is sized such that the internal diameter of the ring (from opposing rib to opposing rib) is slightly smaller than the threaded portions 54 and 154 of retainers 34, 134. As shown in FIG. 1, the ring may be disposed loosely on the line 20 or may be forced over the threads 54, 154 of the retainers 34, 134 and captured against the stop surfaces 38, 138. The flexible nature of the rings and their ribs provides for passage of the ribs over the threaded portion of the retainer 34. Alternatively, the rings 50 and 150 could be formed of other material and without the ribs 51. The inner surface of the rings would be sized so that the internal diameter of the ring is slightly smaller than the ring retainers 34 (whether in the form of thread studs or grooved, flanged or lipped ends of the handles 30 and 130).

Figure 3:
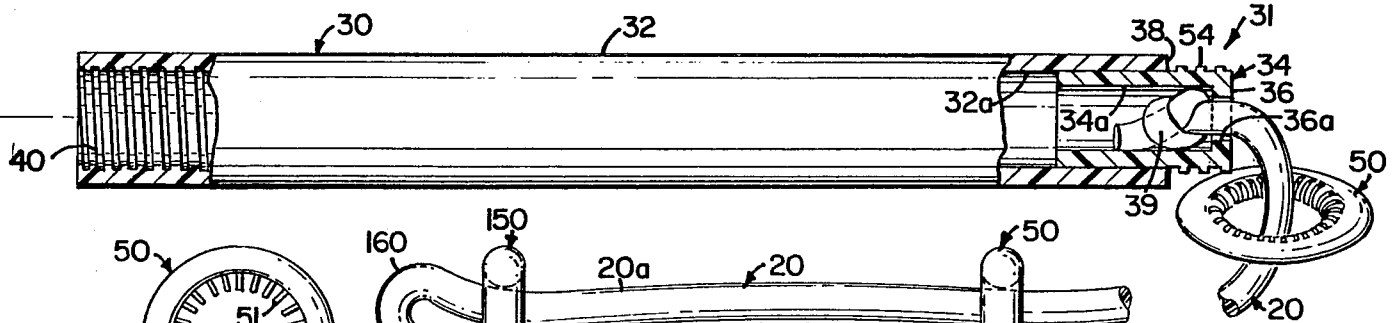
FIG. 3 is a view of a line of an apparatus of the present invention showing the line folded to modify the shape of the line with the line retained in the folded position by rings of FIG. 2.
Figure 3:
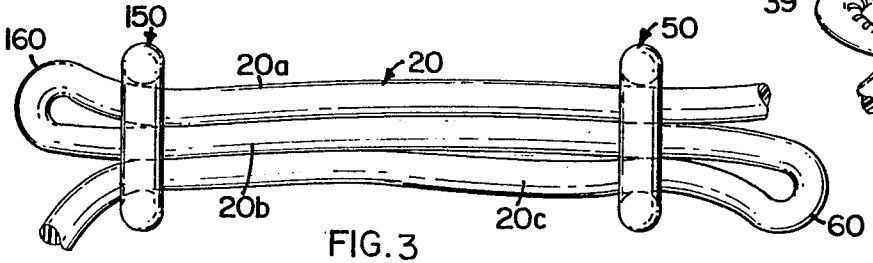

As shown in FIG. 3, the flexible line 20 may be folded over onto itself and, in one embodiment may be folded with two loops 60 and 160 to provide three adjacent layers 20*a*, 20*b* and 20*c* of line 20. Ring 50 may be passed over the first loop 60 with ring 50 surrounding all three layers 20*a*, 20*b* and 20*c* of the folded line 20 and likewise, ring 150 may be passed over the second loop with ring 150 surrounding all three layers of the folded line 20. With the rings so disposed, the length of the line 20 is shortened or its shape modified for purposes as will be described.

An exercise apparatus having the structure of the present invention provides for several advantages not available with prior art devices. As will be readily appreciated, the apparatus is light weight and can be stored in space sufficiently small to permit transport of the apparatus in a brief case or in a suitcase or alternatively, the apparatus may be handily stored in an office desk drawer. In addition to its light weight, ease of manufacture and transportability, the apparatus, unlike prior art exercise apparatus, may be effectively used in an exercise program to provide a multitude of exercise functions. For example, the apparatus may be used to stimulate the cardiovascular system. In this regard, the handle members 30 and 130 are separated and separately grasped in separate hands of an operator. The rings 50 and 150 are disposed on the retainers 34 and 134 adjacent the shoulder stops 38, 138. With the apparatus so arranged, it may be readily used as a jump rope with the knots or toggles of the line 20 freely rotatable within the handles 30 and 130 (as shown with reference to handle 30).

In addition to serving as a jump rope to stimulate the cardiovascular system, the apparatus may be used in muscle development exercises. To perform this function of exercise, the handle portions are attached by threadedly receiving stud 45 into the internal threads 40 of the second handle 130. With the composite handle thus formed, and with rings 50 and 150 still secured on ring retainers 34 and 134, respectively, an operator may stand on the line 20 with the composite handle grasped by the operator's hands spread apart on the handle 30, 130 adjacent the line receiving ends 31 and 131. In this position, an operator can use the apparatus to perform what is commonly known as a military press by simply urging the composite handle 25 away from the operator's feet with the resilient line 20 providing opposition to this movement. This use is shown in FIG. 4.

If it is desired to provide muscular development for muscle groups other than those that would be affected through the military press, the apparatus can be used in another manner. For example, the rings 50 and 150 may be removed from their retainers 34 and 134 and the line may be folded as previously described with the rings passed over the loops 60 and 160 and surrounding the folded line 20. In this manner, the shape of line 20 can be modified to shorten the line and present two loops 60 and 160 depending from rings 50 and 150 (it will be appreciated the loops can be formed with a single ring 50). For example, the line may be shortened such that the distance from the composite handle to the end of an extended line is slightly less than waist height of an operator. With the line so shortened, the operator may place his feet within each of loops 60 and 160 and grasp the extended handle and draw the handle towards his chest to perform a strength exercise commonly known as a curl as shown in FIG. 5.

It will be appreciated that numerous other strength exercises can be performed such as by shortening the length or adjusting the shape of of the line 20 and placing the line over the operator's back with the hands grasping the composite handle and forcing it away from the operator's chest. Commonly known as a bench press, this exercise is illustrated in FIG. 8.

The line 20 can also be modified to perform exercises for development of chest muscles. Such a use is shown in FIG. 9 where the line 20 is modified by placement of the rings 50 and 150 to define the loops 60 and 160. With each hand, an operator grasps a loop and either handle 30 or handle 130.

In all of the strength exercises where the line is modified as described, the rings 50 and 150 retain the line in the modified state. The exercise involves repetitive movement of muscle groups against a resistance. The line 20 makes a substantial bend at the rings and the rings are aligned in a position at an angle to the line. Due to the relative dimensions of the line and the rings, the rings restrict the line from passing through the rings and effectively hold the line 20 in the modified state. The inside diameter of the ring is sized to be slightly less than three times the diameter of the line.

In addition to providing an apparatus for performing cardiovascular and muscular development exercise, the apparatus can also be effectively used as a stretching apparatus. With reference to FIG. 6, an operator is shown lying on the ground with the line 20 at its fully extended position with the feet of the operator engaging the line and the hands of the operator grasping the handle which have been formed into a composite handle. The operator extends to a fully stretched position and maintains that position for a set period of time. Accordingly, muscles are stretched against a resistance. Also, as shown in FIG. 7, the apparatus can be used in specialized eye exercises for special exercise needs of, for example, peripheral vision, as previously discussed where an operator holds the line at an angle permitting one of the rings to slide down the line. By maintaining the head in a position fixed relative to the line, the operator's eyes must follow the ring which provides exercise for the operator's eyes. The exercise also improves timing and reflexes since the line 20 is rocked to change its inclination stopping the ring at predetermined points (indicated by indicator markings 80 and 180) and continuously require coordinated eye-hand movements.

FIG. 10 represents a very specialized use of the apparatus of the present invention. FIG. 10 illustrates how the handles 30 and 130 can be joined to form the composite handles with the rings 50 and 150 placed on the line 20 to define the loops 60 and 160. With the line 20 so modified, the loop 60 and 160 can be disposed over foot rests 90 and 190 of the wheel chair 95. An occupant can grasp the composite handle and draw the composite handle away from the foot rest against the resistance of the line 20. With the arrangement, wheel chair occupants who are restricted in their ability to obtain greatly needed exercise can exercise on a regular basis.

From the foregoing it can be seen how the objects of the invention have been attained in a preferred manner. The exercise device provides for numerous exercise programs such as aerobic or muscle development programs. Also, the attachable handle and rings provide remarkable diversity. The rings are particularly beneficial in that they provide a lock means which will not tighten to an unmanageable point as will a common knot made in a line. While the foregoing is a preferred embodiment of the present invention, it will be appreciated that it is the intent to include within the scope of the invention such modifications and equivalents as will appear to those skilled in the art. Accordingly, it is intended that the scope of the present invention be limited only by the claims which are appended hereto.

What is claimed is:

1. An exercise apparatus, comprising:

an elastic flexible line having a length sufficient for an operator to use said line as a jump rope;

a pair of rigid handles including a first handle and a second handle each having a line receiving end and a longitudinally displaced handle attching end, each of said handles including means for releasably attaching said handle with the other of said handles at said handle attaching ends to form a composite handle with said line receiving ends longitudinally displaced;

means for rotatatably securing ends of said line to said line receiving ends; and means for releasably holding said line in a folded position so as to create loops at opposite ends of the folded line, said means for releasably holding said line including means surrounding said line and having an inside dimension sized for said surrounding means to freely pass along said line and resistively pass along said folded line.

2. An exercise apapratus according to claim 1 wherein said line receiving ends of said handles are provided with means for securing said ring to said handle.

3. An exercise apparatus according to claim 1 wherein said handles each include an elongated body with a cylindrical body portion, the cylindrical body portion of said first handle having an outside diameter substantially identical to the outside diameter of the cylindrical body portion of said second handle, said attaching means attaching said handles at said handle attaching ends with said cylindrical body portions rigidly connected and axially aligned.

4. An exercisé apparatus according to claim 3 wherein a handle attaching end of said first handle is provided with an axially extending threaded stud and said handle attaching end of said second handle is provided with an internally threaded bore sized to receive said axially extending threaded stud.

5. An exercise apparatus according to claim 3 wherein a handle attaching end of each of said first and second handles is provided with an internally threaded bore; a stud having two axially extending threaded ends sized to be received within each of said internally threaded bores and aligned to retain said first and second handles in axial alignment.

6. An exercise apparatus, comprising:

an elastic flexible line have a length sufficient for an operator to use said line as a jump rope;

a pair of rigid cylindrical handles including a first cylindrical handle and a second cylindrical handle each having a line receiving end and an axially displaced handle attaching end; means for releasably attaching said handles at said handle attaching ends with said handles axially aligned to form a composite cylindrical handle and with said line receiving ends disposed on axially aligned opposite ends of said composite handle;

means for securing ends of said line to said line receiving ends;

a pair of flexible rings surrounding said line with said rings having an inside diameter sized for said rings to freely pass over a single strand of said line but sized to resistively pass over a folded line;

said handle attaching ends having outside dimensions sized slightly greater than an inside dimension of said rings.

7. A method of using an exercise apparatus having an elastic flexible line having a length sufficient for an operator to use said line as a jump rope; a pair of rigid handles each having a line receiving end and a longitudinally displaced handle attaching end; means for releasably attaching said handles at said handle attaching ends to form a composite handle with said line receiving ends longitudinally displaced; means for securing ends of said line to said line receiving ends; and ring lock means for holding said line in a folded position with said folded line having a reduced length between said line receiving ends with said ring lock means including a pair of rings having inside diameters for said rings to freely pass over said line and resistably pass over a folded line; the method comprising the steps of:

attaching said handles at said handle attaching ends to form a composite handle;

folding a portion of said line to provide a first loop and a second loop;

urging a first ring along said line and over said first loop with said first ring surrounding said folded line adjacent said first loop and urging said second ring along said line and over said second loop;

resistively passing said folded line through said rings to adjust a total length of said line between the line receiving ends of said handles to a desired length for said line to engage a portion of said operator's body with said operator engaging said composite handle; and exercising said body portion by relatively moving said portion away from said handle against a resilient resistance of said line.

8. A method of using an exercise apparatus having an elastic flexible line having a length sufficient for an operator to use said line as a jump rope; a pair of rigid handles each having a line receiving end and a longitudinally displaced handle attaching end; means for releasably attaching said handles at said handle attaching ends to form a composite handle with said line receiving ends longitudinally displaced; means for securing ends of said line to said line receiving ends; and ring lock means for holding said line in a folded position with said folded line defining a pair of loops and with said ring locking means including a ring having an inside diameter for said ring to freely pass over said line and resistably pass over a folded line; the method comprising the steps of:

attaching said handles at said handle attaching ends to form a composite handle;

folding a portion of said line to provide a first loop and a second loop;

urging a ring along said line and over said folded portion to hold said line in said folded position;

placing said first loop over a first foot of said operator and said second loop over a second foot of said operator with said operator's hands grasping said composite handle; and exercising by pulling said composite handle away from said operator's feet against a resilient resistance of said line.

9. A method of using an exercise apparatus having an elastic flexible line having a length sufficient for an operator to use said line as a jump rope; a pair of rigid handles each having a line receiving end and a longitudinally displaced handle attaching end; means for releasably attaching said handles at said handle attaching ends to form a composite handle; means for securing ends of said line to said line receiving ends; ring lock means for holding said line in a folded position with said folded line presenting a first loop and a second loop with said ring locking means including a ring having an inside diameter for said ring to freely pass over said line and resistably pass over said folded line; the method comprising the steps of:

retaining said handles detached to provide a first separate handle and a second separate handle;

folding a portion of said line to provide a first loop and a second loop;

urging said ring along said line and over said folded line with said ring holding said line in said postiion defining said first and second loops;

grasping with a first hand of said operator a first handle and a first loop and grasping a second handle and a second loop with a second hand of said operator; and exercising by urging said hands apart against a resilient resistane of said line.

* * * * *